US010755876B2

(12) United States Patent
Doro et al.

(10) Patent No.: US 10,755,876 B2
(45) Date of Patent: Aug. 25, 2020

(54) PUSH SWITCH

(71) Applicant: PANASONIC INTELLECTUAL PROPERTY MANAGEMENT CO., LTD., Osaka (JP)

(72) Inventors: Kunio Doro, Okayama (JP); Yumi Nakai, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/333,180

(22) PCT Filed: Sep. 13, 2017

(86) PCT No.: PCT/JP2017/032948
§ 371 (c)(1),
(2) Date: Mar. 13, 2019

(87) PCT Pub. No.: WO2018/051995
PCT Pub. Date: Mar. 22, 2018

(65) Prior Publication Data

US 2020/0185166 A1 Jun. 11, 2020

(30) Foreign Application Priority Data

Sep. 13, 2016 (JP) ..... 2016-178845

(51) Int. Cl.
*H01H 13/20* (2006.01)
*H01H 13/04* (2006.01)
(Continued)

(52) U.S. Cl.
CPC ..... *H01H 13/20* (2013.01); *H01H 13/04* (2013.01); *H01H 13/14* (2013.01); *H01H 13/50* (2013.01); *H01H 2215/00* (2013.01)

(58) Field of Classification Search
CPC .. H01H 13/14; H01H 13/52; H01H 2205/002; H01H 2215/004; H01H 13/12;
(Continued)

(56) References Cited

U.S. PATENT DOCUMENTS 6,107,586 A 8/2000 Takeuchi et al.
8,698,028 B2 * 4/2014 Ishigame ..... H01H 13/85 200/406
(Continued)

FOREIGN PATENT DOCUMENTS

JP S50-115562 U 9/1975
JP H11-144562 A 5/1999
(Continued)

OTHER PUBLICATIONS

International Search Report and Written Opinion issued in International Patent Applicaiton No. PCT/JP2017/032948, dated Nov. 14, 2017; with partial English translation.

*Primary Examiner* — Ahmed M Saeed
(74) *Attorney, Agent, or Firm* — McDermott Will & Emery LLP

(57) ABSTRACT

A push switch having the contact piece including a support part supported on a base member, a movable contact part, and an interconnection part interconnecting the support part and the movable contact part. The movable contact part is movable between a position contacting a first fixed contact part and a position separate from the first fixed contact part. The contact piece is configured so that, when a pressure reception member is pushed to be moved closer to a specific surface of the base member to cause change in shape of the movable member, the interconnection part is pushed by the movable member and the movable contact part is moved along operation directions. The movable contact part located at a position facing a through hole in the operation directions. The movable contact part has a size and shape to be allowed to pass through the through hole in the operation directions.

11 Claims, 8 Drawing Sheets

(51) Int. Cl.
*H01H 13/50* (2006.01)
*H01H 13/14* (2006.01)

(58) Field of Classification Search
CPC ..... H01H 1/20; H01H 2013/525; H01H 2205/004; H01H 13/48; H01H 2215/018; H01H 13/85; H01H 13/10; H01H 13/44; H01H 13/64; H01H 1/403; H01H 13/50; H01H 13/04; H01H 2215/00
See application file for complete search history.

(56) References Cited

U.S. PATENT DOCUMENTS 8,723,065 B2 * 5/2014 Kikuchi ..... H01H 1/5805 200/512
2011/0303520 A1 * 12/2011 Burnel ..... H01H 13/44 200/512
2012/0043189 A1 * 2/2012 Kodama ..... H01H 15/005 200/329
2012/0048707 A1 * 3/2012 Nakamura ..... H01H 13/14 200/517
2012/0111712 A1 * 5/2012 Cour ..... H01H 13/48 200/511
2012/0241302 A1 * 9/2012 Ishigame ..... H01H 13/85 200/530
2013/0062170 A1 3/2013 Takeuchi et al.
2014/0311882 A1 * 10/2014 Terashita ..... H01H 13/10 200/520
2014/0318938 A1 10/2014 Takeuchi et al.

FOREIGN PATENT DOCUMENTS

JP 2002-124153 A 4/2002
JP 2011-100678 A 5/2011
JP 2013-058380 A 3/2013

* cited by examiner

PUSH SWITCH

CROSS-REFERENCE OF RELATED APPLICATIONS

This application is the U.S. National Phase under 35 U.S.C. § 371 of International Patent Application No. PCT/JP2017/032948, filed on Sep. 13, 2017, which in turn claims the benefit of Japanese Application No. 2016-178845, filed on Sep. 13, 2016, the entire disclosures of which Applications are incorporated by reference herein.

TECHNICAL FIELD

The present invention generally relates to push switches, and particularly relates to a push switch to be turned on and off in response to change in shape of its movable member.

BACKGROUND ART

Patent Literature 1 discloses a push switch having configurations where a cover covers from above a case on which a switch contact part is mounted.

The push switch disclosed in Patent Literature 1 includes a case formed into a box shape with an open upper face. Located in a recess surrounded by a wall of the case is a movable member (movable contact) formed into a dome shape protruding upward. There is a protection sheet located above the case to cover the recess. The protection sheet has a peripheral part located on and overlapped with an upper end of the wall of the case, and the peripheral part is welded and fixed to the case with laser irradiation.

To manually operate this push switch, force is applied to the protection sheet form the above and such force is transferred to the movable member and causes change in shape (elastic inversion) of the movable member such that the movable member protrudes downward. Thus, a lower surface of the metal member comes into contact with a central contact formed on an inner bottom surface of the recess of the case, and the push switch is turned on. When the force applied to the protection sheet is removed, the metal member is changed into its original shape (the dome shape protruding upward) (elastic recover), and the push switch is turned off.

By the way, in the aforementioned push switch, a single movable member provides both of feeling during manual operation and electric contact (contact with the central contact). Therefore, in depth directions of the recess, the push switch can be lowered in height. In contrast, in the push switch with such configurations, the feeling during manual operation and electric contact states (e.g., contact pressure) cannot be designed separately. The design for the electrical contact states may limit realizable feeling during manual operation.

CITATION LIST

Patent Literature

Patent Literature 1 JP 2013-58380 A

SUMMARY OF INVENTION

In view of the above insufficiency, an object of one aspect of the present disclosure would be to propose a push switch capable of being lowered in height and of providing various feeling during manual operation.

A push switch according to a first aspect of the present disclosure includes: a fixed contact part; a base member; a contact piece; and a movable member. The base member supports the fixed contact part. The contact piece is located at a position facing a specific surface of the base member in operation directions. The movable member includes a pressure reception member and located at a position on an opposite side of the contact piece from the specific surface of the base member in the operation directions. The movable member includes a through hole which is located in an area surrounding the pressure reception member and penetrates the movable member in the operation directions. The contact piece includes a support part supported on the base member, a movable contact part movable between a position in contact with the fixed contact part and a position separate from the fixed contact part, and an interconnection part interconnecting the support part and the movable contact part. The contact piece is configured so that, when the pressure reception member is pushed to be moved closer to the specific surface of the base member to cause change in shape of the movable member, the interconnection part is pushed by the movable member and the movable contact part is moved along the operation directions. The movable contact part is located at a position facing the through hole in the operation directions and having a size and shape to be allowed to pass through the through hole in the operation directions.

A push switch according to a second aspect of the present disclosure is based on the first aspect, wherein the contact piece is a cantilever with the support part serving as a fixed end and the movable contact part serving as a free end.

A push switch according to a third aspect of the present disclosure is based on the first or second aspect, wherein the base member includes a setback which is located at a position in the specific surface facing the interconnection part in the operation directions and is recessed in a direction apart from the interconnection part.

A push switch according to a fourth aspect of the present disclosure is based on the third aspect wherein the contact piece is configured to change in shape allowing the interconnection part to enter the setback when the interconnection part is further pushed by the movable member in a state where the interconnection part is pushed by the movable member to allow the movable contact part to be in contact with the fixed contact part.

A push switch according to a fifth aspect of the present disclosure is based on any of the first to fourth aspects, wherein: the interconnection part includes a protruded part protrude in the operation directions but away from the specific surface of the base member; and the contact piece is configured to come into contact with the movable member at the protruded part when the pressure reception member is pushed.

A push switch according to a sixth aspect of the present disclosure is based on any one of the first to fifth aspects, wherein: the base member is at least part of a case including a recess; the contact piece is at least part of a contact member which is electrically conductive; the specific surface of the base member is a bottom surface of the recess; and the movable member and the contact member are located inside the recess.

A push switch according to a seventh aspect of the present disclosure is based on the sixth aspect, wherein: the base member further includes a second fixed contact part which is electrically insulated from the fixed contact part serving as a first fixed contact part; the first fixed contact part and the second fixed contact part are located on the specific surface of the base member and separate from each other; the contact member includes the contact piece and a support frame in permanent contact with the second fixed contact part; and the contact piece protrudes along the specific surface of the base member from part of the support frame so that the movable contact part is located at a position facing the first fixed contact part in the operation directions.

A push switch according to an eighth aspect of the present disclosure is based on the sixth or seventh aspect, wherein the case includes at least part of an internal side surface of the recess a movement limitation part for limiting movement of the contact member and the movable member in an imaginary plane parallel to the specific surface of the base member by coming into contact with the contact member and the movable member.

A push switch according to a ninth aspect of the present disclosure is based on any one of the sixth to eighth aspects, wherein the movable member includes a body including the pressure reception member and the through hole, and four legs individually protruding in four directions from an outer periphery of the body when viewed in one of the operation directions.

A push switch according to a tenth aspect of the present disclosure is based on any one of the sixth to ninth aspects, wherein: the movable member includes in an area surrounding the pressure reception member a plurality of holes which have a same shape and are arranged in a circumferential directions at regular intervals; and the through hole is one of the plurality of holes.

A push switch according to an eleventh aspect of the present disclosure is based on any one of the sixth to tenth aspects, and further includes a protection sheet which is joined to an area surrounding the recess, of the case and covers the recess. The case includes a groove for forming a gap between at least part of the area surrounding the recess and the protection sheet. The groove serves as a vent which is between the case and the protection sheet and interconnects an inside of the recess and an outside of the recess.

DESCRIPTION OF EMBODIMENTS

The following description referring to drawings is made to push switches of embodiments according to the present disclosure. Note that, elements, components, or configurations described hereinafter are mere examples in the present disclosure, and the present disclosure is not limited to disclosing the following elements, components, or configurations. Hence, the following elements, components, or configurations may be modified in various manners in accordance with designs or the like, provided that they do not deviate from the scope based on the technical concept anticipated by the present disclosure.

(Embodiments)

(1) Overviews

Figure 1:
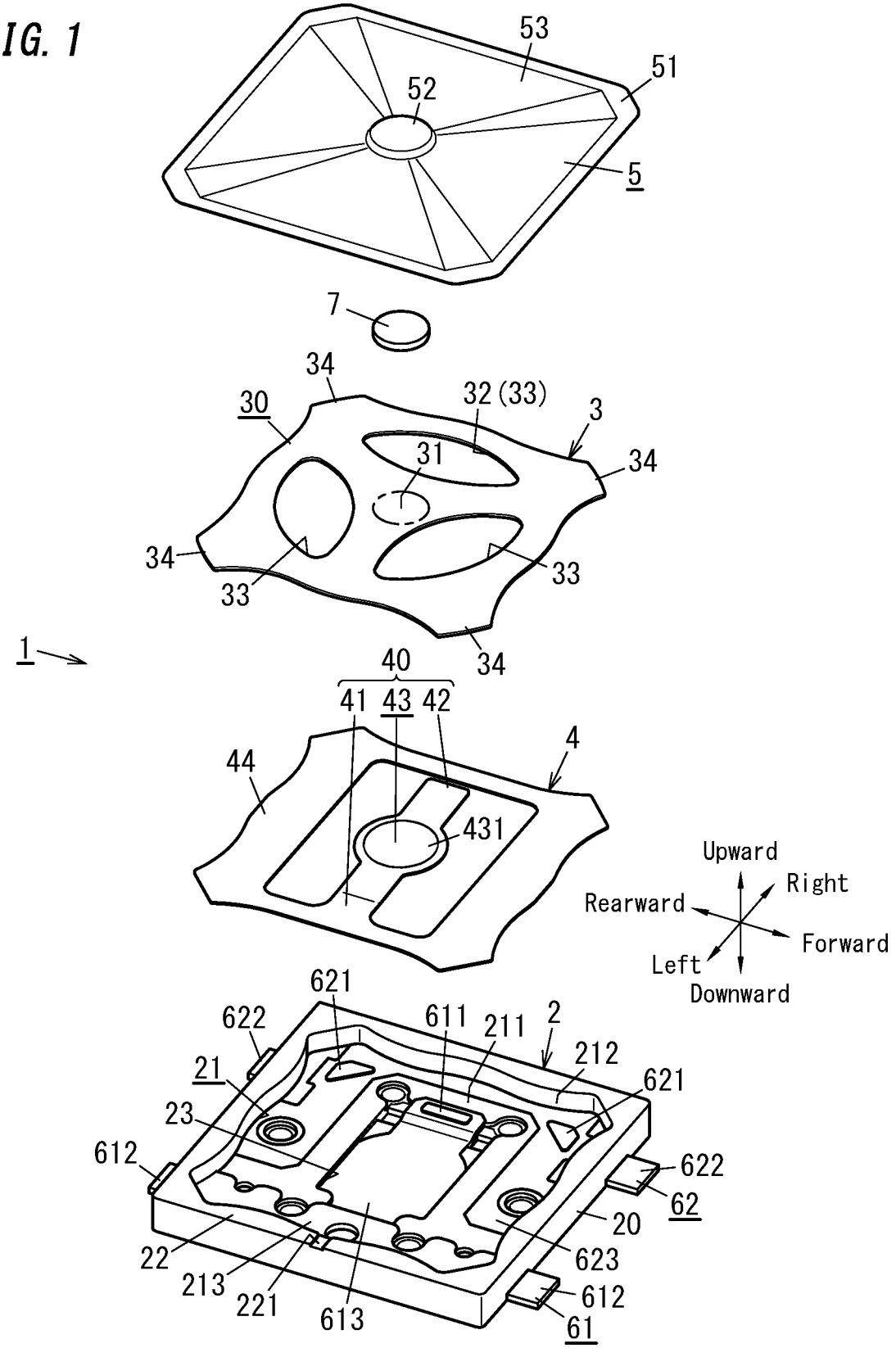
FIG. 1 is an exploded perspective view of a push switch of an embodiment according to the present disclosure.
Figure 2:
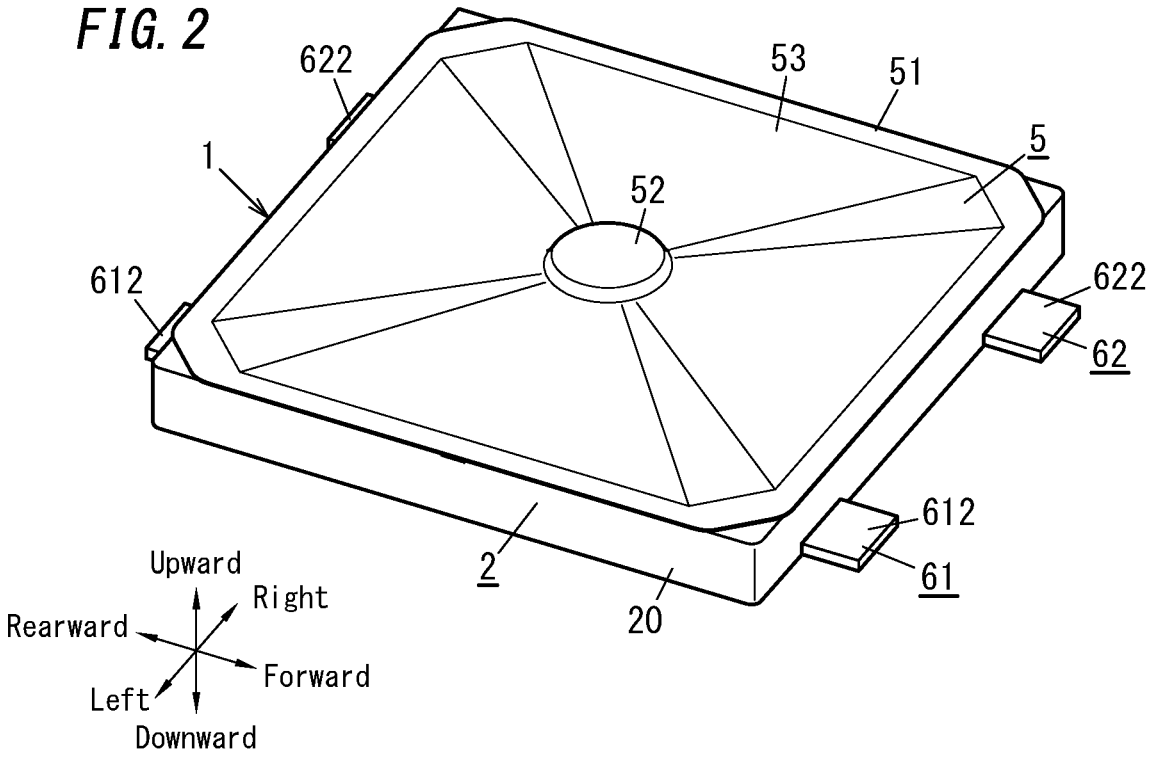
FIG. 2 is a perspective view of the push switch of the above.

As shown in FIG. 1 and FIG. 2, a push switch 1 according to the present embodiment includes a first fixed contact part 611 (fixed contact part), a base member 20, a movable member 3, and a contact piece 40.

The base member 20 supports the first fixed contact part 611. The contact piece 40 is located at a position facing a specific surface 211 of the base member 20 in operation directions (manual operation directions). The movable member 3 includes a pressure reception member 31. The movable member 3 is located at a position on an opposite side of the contact piece 40 from the specific surface 211 of the base member 20 in the manual operation directions. The movable member 3 includes a through hole 32 which is located in an area surrounding the pressure reception member 31 and penetrates the movable member 3 in the manual operation directions.

The contact piece 40 includes a support part 41 supported on the base member 20, a movable contact part 42, and an interconnection part 43 interconnecting the support part 41 and the movable contact part 42. The movable contact part 42 is movable between a position in contact with the first fixed contact part 611 and a position separate from the first fixed contact part 611. The contact piece 40 is configured so that, when the pressure reception member 31 is pushed to be moved closer to the specific surface 211 of the base member 20 to cause change in shape of the movable member 3, the interconnection part 43 is pushed by the movable member 3 and the movable contact part 42 is moved along the manual operation directions. The movable contact part 42 is located at a position facing the through hole 32 in the manual operation directions. The movable contact part 42 has a size and shape to be allowed to pass through the through hole 32 in the manual operation directions.

In summary, regarding the push switch 1, the contact piece 40 and the movable member 3 are placed and stacked over the specific surface 211 of the base member 20 in the order of the contact piece 40 and the movable member 3. In other words, the contact piece 40 is located between the movable member 3 and the specific surface 211 of the base member 20 in the manual operation directions. In this regard, for example, in the case where the movable member 3 is a dome-shaped thin plate member, the movable member 3 is suddenly changed in shape due to so-called inversion when the pressure reception member 31 of the movable member 3 is pressed from the opposite side thereof from the specific surface 211 of the base member 20. In this process, the interconnection part 43 of the contact piece 40 is pushed by the movable member 3 and therefore the movable contact part 42 of the contact piece 40 is moved in the manual operation directions to come into contact with or separate from the first fixed contact part 611. As understood from the above, the push switch 1 is turned on and off by pushing the movable member 3. In detail, when the pressure reception member 31 of the movable member 3 is pushed, the movable member 3 is changed in shape and accordingly the contact piece 40 between the movable member 3 and the specific surface 211 of the base member 20 is indirectly pushed. Then, the movable contact part 42 of the contact piece 40 comes into contact with or separates from the first fixed contact part 611 held by the base member 20.

In such configuration, (tactile) feeling during manual operation (tactile response) of the push switch 1 is ensured by the movable member 3 and the electrical connection (contact with the first fixed contact part 611) is realized by the contact piece 40. In other words, in the push switch 1, the movable member 3 and the contact piece 40 are independently in charge of ensuring the feeling during manual operation and the electric connection. The feeling during manual operation and the electrical connection can be designed separately. Therefore, the push switch 1 can realize various feeling during manual operation without limitation by electrical connection conditions.

In this regard, a dimension of the push switch 1 in the manual operation directions (i.e., height) is larger in configuration where the movable member 3 and the contact piece 40 are merely placed and stacked in the manual operation directions, than in configuration where only the movable member 3 is in charge of ensuring the feeling during manual operation and electric connection both. In view of this, in the push switch 1 according to the present embodiment, the movable member 3 is provided with the through hole 32 penetrating the movable member 3 in the manual operation directions, and the movable contact part 42 is located at a position facing the through hole 32 in the manual operation directions. Additionally, the movable contact part 42 is formed to have a size and shape to be allowed to pass through the through hole 32 in the manual operation directions. Consequently, interference between the movable contact part 42 and the movable member 3 can be avoided by the through hole 32 even when the movable contact part 42 moves in the manual operation directions. Hence, a distance between the movable member 3 and the contact piece 40 in the manual operation directions can be shortened. In detail, in contrast to configuration where only the movable member 3 is in charge of ensuring the feeling during manual operation and electric connection both, increase in a dimension of the push switch 1 in the manual operation directions can be reduced notwithstanding the contact piece 40 being added between the movable member 3 and the specific surface 211 of the base member 20. Accordingly, the push switch 1 according to the present embodiment can offer advantageous effects of being lowered in height and of providing various feeling during manual operation.

In the present embodiment, a normally-open push switch 1 which is turned on only when operated is described as one example. In the normally-open push switch 1, when push operation of the pressure reception member 31 of the movable member 3 is done, the movable member 3 is changed in shape and the contact piece 40 is pushed indirectly. The movable contact part 42 of the contact piece 40 therefore comes into contact with the first fixed contact part 611 held by the base member 20. Consequently, electric conduction is made between the movable contact part 42 and the first fixed contact part 611 and thus the push switch 1 is turned on. In this regard the "push operation" means operation of pushing the pressure reception member 31 in a direction in which it comes close to the specific surface 211 of the base member 20.

The push switch 1 according to the present embodiment is particularly suitable for a long stroke switch of which a length of a stroke, that is a travel distance (amount of movement) of the pressure reception member 31 due to the push operation, is relatively long. Further, the push switch 1 is particularly suitable for an over stroke switch which is one of long stroke switches and allows further movement (i.e., over stroke) of the pressure reception member 31 when the push operation of the pressure reception member 31 is done after the movable contact part 42 is in contact with the first fixed contact part 611.

The over stroke push switch 1 does not increase manual operation load suddenly just after the push switch 1 is turned on when the movable contact part 42 is in contact with the first fixed contact part 611 but can delay the timing at which the manual operation load increases suddenly. In this regard, the "manual operation load" means amount of force applied on the push switch 1 by a finger of a user when the user performs the push operation of the push switch 1 by the finger, and is equal to amount of reaction force applied on the finger of the user by the push switch 1. In general push switches 1, the manual operation load increases suddenly at the end point of a movable range of the pressure reception member 31. In the over stroke push switches 1, the end point of the movable range of the pressure reception member 31 is not a position where the push switch 1 is turned on but a position where the pressure reception member 31 is further pushed from the position where the push switch 1 is turned on. Therefore, in the over stroke push switches 1, the timing at which the manual operation load increases suddenly can be delayed by amount corresponding to a distance by which the pressure reception member 31 moves from the position where the push switch 1 is turned on to the end point of the movable range of the pressure reception member 31.

Accordingly, the over stroke push switches 1 can reduce tiredness of a user (operator) who perform operation (the push operation) of the push switch 1 actually, and may be particularly suitable for applications used for long term input operation such as keyboards of information devices, for example. By applying the push switches 1 according to the present embodiment to keyboards, the keyboards can be thinned because the push switches 1 can be lowered in height.

(2) Details

The push switch 1 described below is used in a manual operation unit of various equipment such as information devices and home appliances. The push switch 1 may be accommodated in a case of a device while it is mounted on a printed substrate, for example. In this case, a manual operation button is located at part of the case which corresponds to the push switch 1, for example. Accordingly, when a user pushes the manual operation button, the push switch 1 is indirectly operated through the manual operation button.

Figure 3:
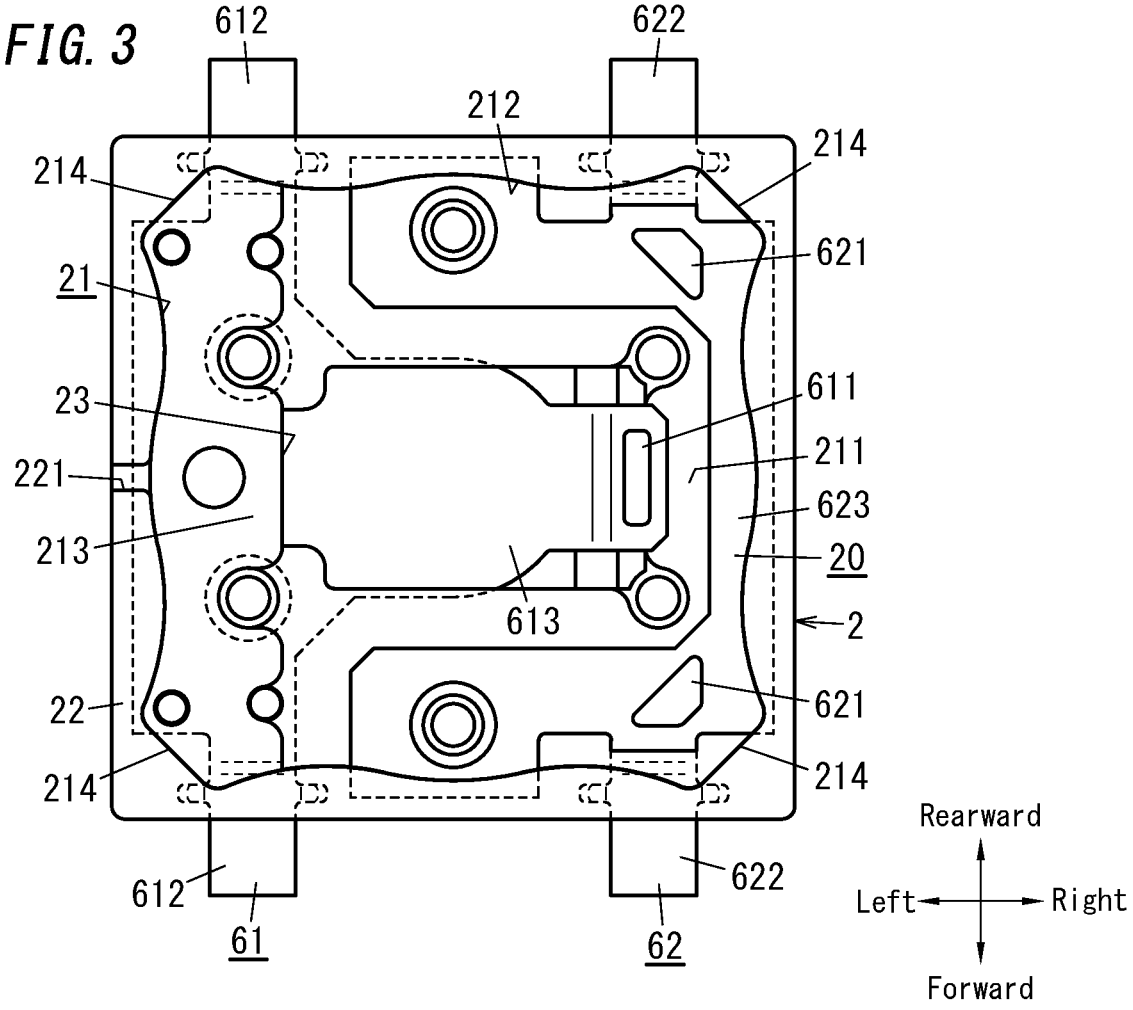
FIG. 3 is a plan view of the push switch of the above in which a protection sheet, a push member, a movable member, and a contact member are removed.
Figure 4A:
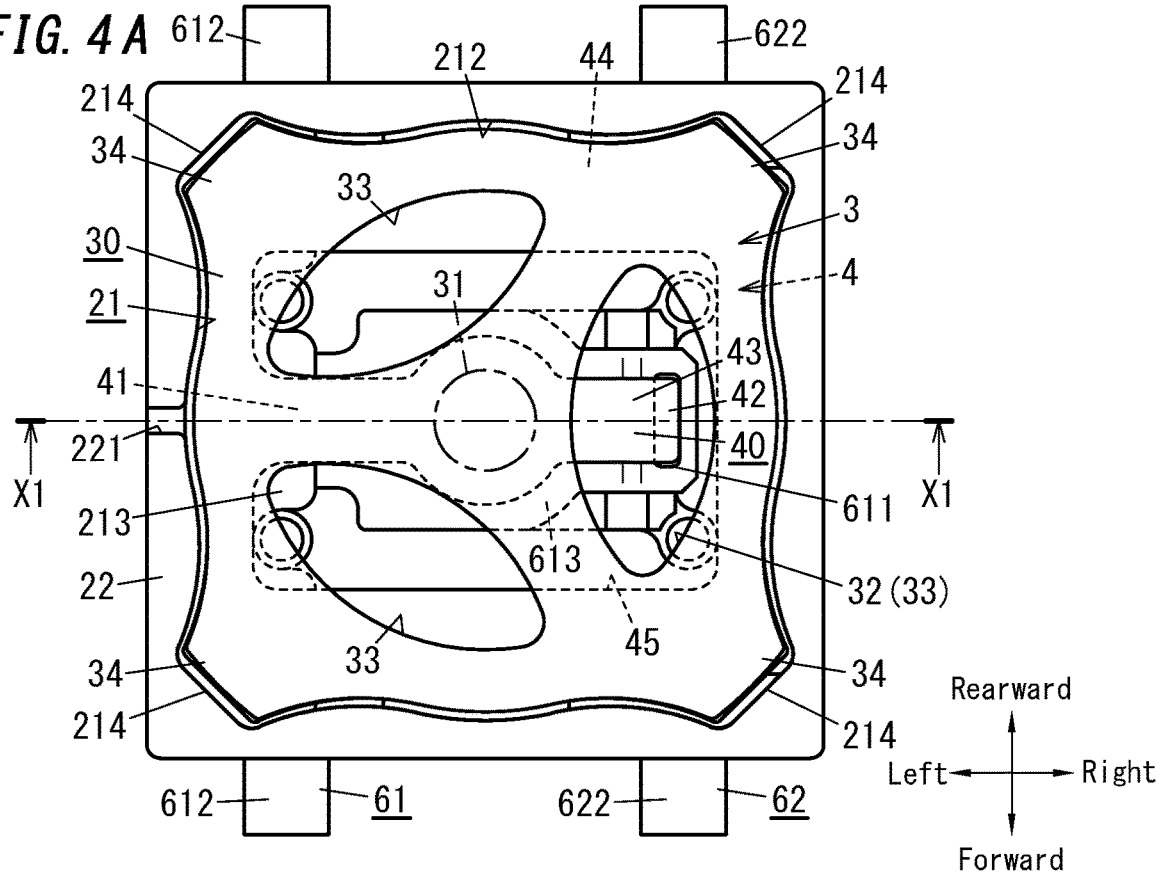
FIG. 4A is a plan view of the push switch of the above in which the protection sheet and the push member are removed.
Figure 4B:
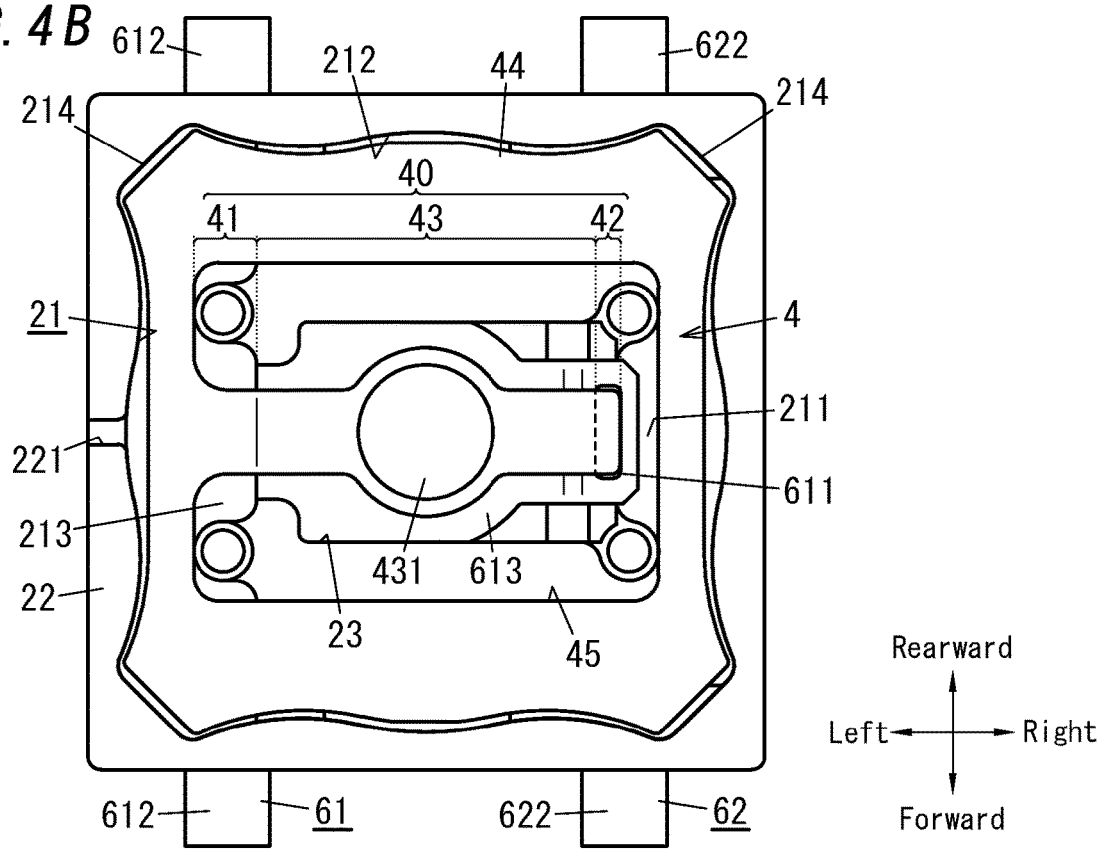
FIG. 4B is a plan view of the push switch of the above in which the protection sheet, the push member, and the movable member are removed.

Hereinafter, unless otherwise noted, "upward and downward directions" mean directions perpendicular to the specific surface 211 of the base member 20 (i.e., directions perpendicular to the sheet of FIG. 3). And, in relation to the upward and downward directions of the base member 20, one direction thereof in which the specific surface 211 faces is considered as an "upward" direction, and another direction in which the opposite surface faces is considered as a "downward" direction. Accordingly, in the following descriptions, the "manual operation directions" are identical to the "the upward and downward directions". Additionally, directions in which first terminals 612 and second terminals 622 described below protrude from the base member 20 (the case 2) are treated as the "forward and rearward directions", and directions perpendicular to the upward and downward directions and the forward and rearward directions both (directions perpendicular to the sheet of FIG. 5) are treated as the "left and right directions". In summary, "upward", "downward", "left", "right", "forward", and "rearward" arrows illustrated in FIG. 1 or the like represent in a straightforward manner the upward, downward, left, right, forward and rearward directions, respectively. However, there is no intent to use these directions to limit directions of the push switch 1 in use. Additionally, the arrows representing the directions in figures are described only for facilitating understanding and are intangible.

(2.1) Configurations

Figure 5:
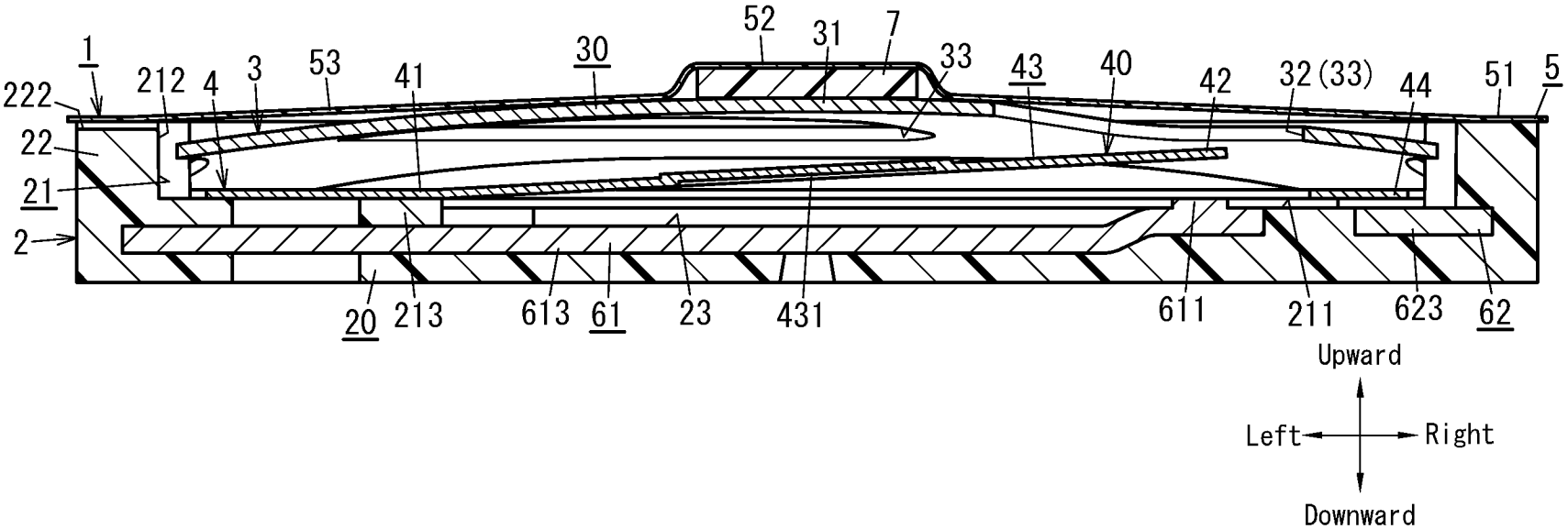
FIG. 5 is a sectional view of the push switch of the above.

As shown in FIG. 1 to FIG. 5, the push switch 1 according to the present embodiment includes a case 2, the movable member 3, a contact member 4, a protection sheet 5, a first metal member 61 and a second metal member 62, and a push member 7. As described in detail below, the case 2 includes the base member 20, the contact member 4 includes the contact piece 40, and the first metal member 61 includes the first fixed contact part 611. In other words, the base member 20 is at least part of the case 2, the contact piece 40 is at least part of the contact member 4, and the first fixed contact part 611 is at least part of the first metal member 61. Further, unless otherwise noted, the following description is made to the push switch 1 in a non-operated state, that is, a state where the push operation of the push switch 1 is not performed. FIG. 5 is a section taken along X1-X1 line of FIG. 4A in condition where the protection sheet 5 and the push member 7 are added.

The case 2 is made of synthetic resin and has electrically insulating properties. The case 2 has a flat cuboidal shape in the upward and downward directions. The case 2 includes a recess 21 open upward. Further, the case 2 includes the base member 20 having a plate shape, and a surrounding wall 22 protruding upward from an outer periphery of the specific surface 211 of the base member 20. In the present embodiment, the base member 20 is formed into a square shape in a top view thereof. And, the surrounding wall 22 is formed into a rectangular frame shape in a top view thereof. In this configuration, the recess 21 is defined as a space surrounded by the specific surface 211 of the base member 20 and an internal side surface 212 of the surrounding wall 22. In other words, the specific surface 211 of the base member 20 serves as a bottom surface of the recess 21, and the internal side surface 212 of the surrounding wall 22 serves as an internal side surface of the recess 21. Therefore, a protrusion amount of the surrounding wall 22 from the specific surface 211 of the base member 20 corresponds to the depth of the recess 21.

The opening shape of the recess 21 is an almost square shape. In the present embodiment, the internal side surface 212 of the recess 21 is curved so that intermediate parts of four sides of the recess 21 bulge outward in a top view thereof. Further, the internal side surface 212 of the recess 21 is curved so that four corners of the recess 21 bulge outward in the top view. As described in detail below, four legs 34 of the movable member 3 are individually accommodated in bulging parts at the four corners of the recess 21. The case 2 has a square shape with corners thereof chamfered in a top view thereof. However, chamfering is not necessary for the push switch 1 but can be omitted appropriately.

Further, in the present embodiment, the base member 20 includes a setback 23 formed in a central part of the bottom surface (the specific surface 211) of the recess 21. As described in detail below, the setback 23 forms a space between the setback 23 and the contact piece 40 for temporarily receive the interconnection part 43 of the contact piece 40 and thus allows overstroke (additional movement of the pressure reception member 31 after contact of the movable contact part 42 with the first fixed contact part 611). For this reason, the setback 23 is formed in part of the specific surface 211 of the base member 20 which faces the interconnection part 43 in the upward and downward directions (the manual operation directions) and is set back from the interconnection part 43. The opening shape of the setback 23 is an almost rectangular shape elongated in the left and right directions. In other words, the recess 21 of the case 2 has two depths so that a center thereof is deep and an outer periphery thereof is shallow. the setback 23 is defined by deep part at the center of the recess 21. The depth of the setback 23 (the height from the bottom surface of the setback 23 to the specific surface 211) is smaller than the depth of the recess 21 (the protrusion amount of the surrounding wall 22 from the specific surface 211).

Further, the base member 20 includes a pedestal 213 which is located at a left end of the bottom surface (the specific surface 211) of the recess 21 and protrudes upward from the specific surface 211. In this regard, the bottom surface of the recess 21 includes a region on the left side of the setback 23 which serves as the pedestal 213 formed into a step higher than the specific surface 211. As described in detail below, the pedestal 213 bears the support part 41 of the contact piece 40.

Additionally, the case 2 includes a groove 221 (see, FIG. 1) which is at part of the area surrounding the recess 21 and forms a gap between the case 2 and the protection sheet 5. In the present embodiment, the groove 221 is formed in an upper surface of part of the surrounding wall 22 serving as a left side wall of the recess 21 and is positioned in a center in the forward and rearward directions.

The first metal member 61 and the second metal member 62 each are made of a metal plate with electrical conductivity, and held by the base member 20 of the case 2. the first metal member 61 and the second metal member 62 are formed integrally with the case 2 by insert molding, for example. The first metal member 61 and the second metal member 62 are arranged in the left and right directions. In the present embodiment, the first metal member 61 is located on the left side of the second metal member 62. The first metal member 61 and the second metal member 62 are electrically separated from each other.

The first metal member 61 includes the first fixed contact part 611 and a pair of first terminals 612. The first fixed contact part 611 is located at center of the first metal member 61 in the forward and rearward directions and the pair of first terminals 612 are located at opposite ends of the first metal member 61 in the forward and rearward directions. As described in detail, the first metal member 61 includes a first main plate 613 interconnecting the pair of first terminals 612. The first main plate 613 is formed into an almost T-shape in a top view thereof including elongated part extending in the forward and rearward directions between the pair of first terminals 612 and part protruding right from the center of the elongated part. An upper surface of a top (right end) of the part protruded right of the first main plate 613 bulges partially, and the bulging part serves as the first fixed contact part 611. In summary, the first fixed contact part 611, the pair of first terminals 612, and the first main plate 613 are formed integrally of a single plate, and electrically coupled with each other.

The first metal member 61 is held by the case 2 (the base member 20) by embedding at least part of the first main plate 613 into the case 2. In this regard, as shown in FIG. 3, part of the first main plate 613 is exposed on the bottom surface of the setback 23. The part of the first main plate 613 exposed on the bottom surface of the setback 23 has an upper surface flush with the bottom surface of the setback 23. Further, a top (right end) of part of the first main plate 613 protruding right is extended to the right side of the setback 23. And, the right end of the first main plate 613 is exposed on the bottom surface of the recess 21 (the specific surface 211) on the right side of the setback 23. The part of the first main plate 613 located on the right side of the setback 23 has an upper surface flush with the specific surface 211. Therefore, the first fixed contact part 611, which is formed by making the upper surface of the right end of the first main plate 613 partially bulge, protrudes upward from the specific surface 211 of the base member 20.

The second metal member 62 includes second fixed contact parts 621 and a pair of second terminals 622. The second fixed contact parts 621 are provided in addition to the first fixed contact part 611 serving as a fixed contact part, and is electrically separated from the first fixed contact part 611. The second fixed contact part 621 is located at center of the second metal member 62 in the forward and rearward directions and the pair of second terminals 622 are located as opposite ends of the second metal member 62 in the forward and rearward directions. As described in detail, the second metal member 62 further includes a second main plate 623 interconnecting the pair of second terminals 622. The second main plate 623 is formed into an almost U-shape in a top view thereof including elongated part extending in the forward and rearward directions between the pair of second terminals 622 and parts individually protruding left from opposite ends of the elongated part. Further, upper surfaces of bases (right ends) of the parts of the second main plate 623 individually protruding left partially bulge and such bulging parts serve as the second fixed contact parts 621. In summary, the second metal member 62 includes a pair of (two) second fixed contact parts 621. The pair of second fixed contact parts 621, the pair of second terminals 622, and the second main plate 623 are formed integrally of a single metal plate, and are electrically coupled with each other.

The second metal member 62 is held by the case 2 (the base member 20) by embedding at least part of the second main plate 623 into the case 2. In this regard, as shown in FIG. 3, the second main plate 623 extends along the surrounding wall 22, and an almost all part thereof is exposed on the bottom surface of the recess 21 (the specific surface 211). In other words, the second main plate 623 is located to surround the setback 23 together with the pedestal 213 within the specific surface 211. Part of the second main plate 623 exposed on the specific surface 211 has an upper surface flush with the specific surface 211. Therefore, the pair of second fixed contact parts 621, which are formed by making the upper surfaces of the right ends of the second main plate 623 partially bulge, protrude upward from the specific surface 211 of the base member 20.

In this regard, the pedestal 213, the first fixed contact part 611, and the pair of second fixed contact parts 621 have the same protrusion amount from the specific surface 211 of the base member 20. Therefore, the upper surface of the pedestal 213, the upper surface of the first fixed contact part 611, and the upper surfaces of the pair of second fixed contact parts 621 are flush with each other.

The pair of first terminals 612 and the pair of second terminals 622 protrude from opposite surfaces of the case 2 in the forward and rearward directions. In detail, one of the first terminals 612 and one of the second terminals 622 protrude forward from a front surface of the case 2 and the other of the first terminals 612 and the other of the second terminals 622 protrude rearward from a rear surface of the case 2. The pair of first terminals 612 and the pair of second terminals 622 have lower surfaces flush with a lower surface of the case 2. These pair of first terminals 612 and pair of second terminals 622 may be physically coupled and electrically connected to conductive part on a printed substrate by soldering, for example.

The movable member 3 is accommodated in the recess 21 of the case 2. The movable member 3 is accommodated in the recess 21 together with the contact member 4. The movable member 3 and the contact member 4 are located and stacked on or over the bottom surface of the recess 21 (the specific surface 211) in order of the contact member 4 and the movable member 3. In other words, the movable member 3 is located on a position on the opposite side (upper side) of the contact member 4 from the specific surface 211 of the base member 20 in the upward and downward directions.

The movable member 3 is formed of elastic plate material exemplified by a plate of metal such as stainless steel (SUS). The movable member 3 includes the pressure reception member 31 and the through hole 32. The movable member 3 includes in an area surrounding the pressure reception member 31 a plurality of holes 33 which have a same shape and are arranged in a circumferential directions of the pressure reception member 31 at regular intervals. The through hole 32 is one of the plurality of holes 33. In the present embodiment, three holes 33 are arranged at regular intervals in the area surrounding the pressure reception member 31 of the movable member 3. The three holes 33 each penetrate the movable member 3 in the upward and downward directions and each of them is formed into a leaf shape in a top view thereof. In this regard, the "leaf shape" means a shape of an overlap of two circles which has the same diameter D1 and are arranged side by side so that a distance between centers thereof is smaller than D1. Among the three holes 33, one hole 33 serving as the through hole 32 is located on a right side of the pressure reception member 31, and remaining two holes 33 are located on a left and forward side and a left and rear side of the pressure reception member 31. These three holes 33 are arranged in line symmetry with regard to a symmetrical axis defined by a center line of the movable member 3 in the forward and rearward directions.

The movable member 3 is formed into a shape corresponding to the recess 21 and slightly smaller than the recess 21 so that it can be accommodated in the recess 21. In more detail, the movable member 3 includes a body 30 and four legs 34. The body 30 is formed into a circular shape and includes the pressure reception member 31 and the three holes 33 (including the through hole 32). The four legs 34 are arranged in a circumferential direction of the body 30 at regular intervals so as to protrude from an outer periphery of the body 30 in four directions when viewed in one direction (upper direction) of the upward and downward directions. The body 30 and the four legs 34 are continuous. The movable member 3 is accommodated in the recess 21 so that the four legs 34 are individually placed in the bulging parts at the four corners of the recess 21. Therefore, movement of the movable member 3 in an imaginary plane parallel to the specific surface 211 of the base member 20 can be restricted by contact of any of the four legs 34 with part of the internal side surface 212 of the recess 21. In other words, the case 2 includes at least part of the internal side surface 212 of the recess 21 a movement limitation part 214 for limiting movement of the movable member 3 in an imaginary plane parallel to the specific surface 211 of the base member 20 by coming into contact with the movable member 3. In the present embodiment, parts of the internal side surface 212 corresponding to the bulging parts at the four corners of the recess 21 constitute the movement limitation part 214 (see FIG. 3).

The body 30 is formed into a dome shape in which a center part is curved to protrude upward. The four legs 34 protrude diagonally downward from the outer periphery of the body 30. Therefore, when the movable member 3 is accommodated in the recess 21 together with the contact member 4, only tops of the four legs 34 of the movable member 3 are in contact with the contact member 4 and part of the movable member 3 other than the tops of the four legs 34 is separate from the contact member 4 (see FIG. 5). And the center part of the body 30 serves as the pressure reception member 31 of the movable member 3. In other words, in the movable member 3, the center part of the body 30 functions as the pressure reception member 31 for receiving force applied on the push switch 1 from the outside of the push switch 1 when the push switch 1 is operated (hereinafter, referred to as "manual operation force").

The contact member 4 is accommodated in the recess 21 of the case 2 together with the movable member 3. As described above, the movable member 3 and the contact member 4 are placed and stacked in the upward and downward directions and the contact member 4 is located between the movable member 3 and the bottom surface of the recess 21 (the specific surface 211).

The contact member 4 is formed of elastic plate material exemplified by a plate of metal such as stainless steel (SUS). At least part of the contact member 4 serves as the contact piece 40. The contact piece 40 includes the support part 41, the movable contact part 42, and the interconnection part 43. The support part 41 is supported or borne by the base member 20. The movable contact part 42 is movable between a position in contact with the first fixed contact part 611 and a position separate from the first fixed contact part 611. The interconnection part 43 interconnects the support part 41 and the movable contact part 42.

The contact member 4 is formed into a shape corresponding to the recess 21 and slightly smaller than the recess 21 so that it can be accommodated in the recess 21. In more detail, the contact member 4 includes the contact piece 40 and a support frame 44. The support frame 44 is formed into a rectangular frame shape with an opening 45. The opening 45 of the support frame 44 is formed into a rectangular shape elongated in the left and right directions. In this regard, the opening 45 is formed larger than at least the opening of the setback 23 so that the setback 23 is exposed through the opening 45. In other words, the support frame 44 is located on the bottom surface of the recess 21 (the specific surface 211) and positioned in an area surrounding the setback 23 so as to extend along the surrounding wall 22. In this regard, a lower surface of the support frame 44 is in contact with the upper surface of the pedestal 213, and the upper surfaces of the pair of second fixed contact parts 621. In summary, the support frame 44 is supported over the specific surface 211 of the base member 20 by the pedestal 213 and the pair of second fixed contact parts 621 to be almost parallel to the specific surface 211. Accordingly, the support frame 44 is always in contact with the pair of second fixed contact parts 621.

The contact piece 40 protrudes from part of the support frame 44 along the specific surface 211 of the base member 20 so that the movable contact part 42 is located at a position facing the first fixed contact part 611 in the upward and downward directions. In the present embodiment, the contact piece 40 is a cantilever which protrudes right from a center in the forward and rearward directions of a left edge of the opening 45 of the support frame 44. In other words, the contact piece 40 protrudes from a center of a left side to a right side, the left and right sides being a pair of opposite sides of the support frame 44 in the left and right directions. In the present embodiment, the support frame 44 and the contact piece 40 (the support part 41, the movable contact part 42, and the interconnection part 43) are formed integrally of a single metal plate.

In this regard, the support part 41 is constituted by the left end of the contact piece 40 continuously connected to the support frame 44, that is, the base of the contact piece 40 corresponding to the fixed end of the cantilever. The movable contact part 42 is constituted by the right end of the contact piece 40, that is, the top or apex of the contact piece 40 corresponding to the free end of the cantilever. In detail, part of the contact piece 40 which faces the pedestal 213 in the upward and downward directions constitutes the support part 41, and part of the contact piece 40 which faces the first fixed contact part 611 in the upward and downward directions constitutes the movable contact part 42. Whole part of the contact piece 40 other than the support part 41 and the movable contact part 42 constitutes the interconnection part 43. The interconnection part 43 and the movable contact part 42 of the contact piece 40 extends diagonally upward right from the support part 41 (see FIG. 5). In other words, part of the contact piece 40 except the support part 41 is inclined relative to the specific surface 211 so that part closer to its top end (right part) more separates from the bottom of the recess 21 (the specific surface 211). Accordingly, in the contact piece 40, bending of the interconnection part 43 allows movement of the movable contact part 42 between a position in contact with the first fixed contact part 611 and a position separate from the first fixed contact part 611.

In this regard, the movable contact part 42 is located at a position facing the through hole 32 in the upward and downward directions. Further, the movable contact part 42 has a size and shape to be allowed to pass through the through hole 32 in the upward and downward directions.

Further, in the present embodiment, the interconnection part 43 includes a protruded part 431 protruding separate from the specific surface 211 of the base member 20 (upward) in the upward and downward directions. The protruded part 431 is located over the center part of the specific surface 211 of the base member 20. The protruded part 431 is formed into a circular shape in a top view thereof. A dimension in the forward and rearward directions (width) of the interconnection part 43 is larger in a vicinity of the protruded part 431 than in other part.

Four corners of the support frame 44 are formed to individually protrude in four directions from the outer periphery of the support frame 44 when viewed in one direction of the upward and downward directions (the upper direction). The contact member 4 is accommodated in the recess 21 so that the four corners of the support frame 44 are individually placed in the bulging parts at the four corners of the recess 21. Therefore, movement of the contact member 4 in an imaginary plane parallel to the specific surface 211 of the base member 20 can be restricted by contact of any of the four corners of the support frame 44 with part of the internal side surface 212 of the recess 21. In other words, the case 2 includes at least part of the internal side surface 212 of the recess 21 the movement limitation part 214 (see FIG. 4A) for limiting movement of the contact member 4 in an imaginary plane parallel to the specific surface 211 of the base member 20 by coming into contact with the contact member 4.

Formed on an entire lower surface of the contact member 4 is a conductive layer with electrical conductivity made by gold (Au) plating, silver (Ag) plating, or the like, for example. This conductive layer gives electrical conductivity to the contact member 4. In other words, the contact member 4 has electrical conductivity. The lower surface of the support frame 44 is always in contact with the pair of second fixed contact parts 621 by way of the conductive layer and the contact member 4 is therefore always electrically coupled to the pair of second fixed contact parts 621. Further, as described in detail in "(2.2) Operations", when manual operation force acts on the pressure reception member 31, the movable member 3 is changed in shape and then the interconnection part 43 of the contact piece 40 is pushed by the movable member 3. Hence, the movable contact part 42 of the contact piece 40 is moved downward and comes into contact with the first fixed contact part 611. In this case, the lower surface of the movable contact part 42 comes into contact with the first fixed contact part 611 with the conductive layer in-between. Therefore the movable contact part 42 is electrically coupled to the first fixed contact part 611. The conductive layer is formed on the lower surface of the contact member 4 entirely and accordingly the contact member 4 has the improved electric conductivity. Electric connection at parts in contact with the pair of second fixed contact parts 621 and the movable contact part 42 can be stabilized.

In summary, the movable contact part 42 and the first fixed contact part 611 constitute a contact device. This contact device is switched between on and off depending on change in shape of the movable member 3 caused by pushing the pressure reception member 31 to come close to the specific surface 211 of the base member 20. In detail, while no manual operation force acts on the pressure reception member 31, the movable contact part 42 is separate from the first fixed contact part 611 and therefore the contact device is off. In this regard, the first metal member 61 and the second metal member 62 are electrically separated and accordingly no electrical conduction is made between the pair of first terminals 612 and the pair of second terminals 622. In contrast, when the manual operation force acts on the pressure reception member 31 and thus the movable contact part 42 comes into contact with the first fixed contact part 611, the contact device is turned on. In this regard, the first metal member 61 and the second metal member 62 are electrically interconnected by the contact member 4 and electrical conduction therefore is made between the pair of first terminals 612 and the pair of second terminals 622.

The protection sheet 5 is made of a flexible sheet of synthetic resin. In this regard, the protection sheet 5 is made of a resin film with thermal resistance and electrically insulating properties. The protection sheet 5 is located over the upper surface of the case 2 (the open surface of the recess 21) to cover the recess 21 entirely. The protection sheet 5 is joined to the area surrounding the recess 21 of the case 2, that is, an upper surface of the surrounding wall 22 of the case 2, thereby covering the recess 21. Accordingly, the protection sheet 5 prevents intrusion of dust, grit and the like into the recess 21 and protects the contact device and the like accommodated in the recess 21, for example. An outer peripheral shape of the protection sheet 5 is almost the same as an outer peripheral shape of the surrounding wall 22 of the case 2 and the protection sheet 5 is slightly larger than the surrounding wall 22. In detail, the protection sheet 5 has a square shape with chamfered four corners in a top view thereof. Note that, chamfering is not necessary for the push switch 1 but can be omitted appropriately.

In the present embodiment, as described above, the groove 221 (see FIG. 1) is formed in at least part of the area surrounding the recess 21 of the case 2 to form a gap between the case 2 and the protection sheet 5. Therefore, formed between the case 2 and the protection sheet 5 is a vent 222 (see FIG. 5) interconnecting the inside of the recess 21 and the outside of the recess 21 by the groove 221. Accordingly, in the push operation of the push switch 1, air flow between the inside of the recess 21 and the outside of the recess 21 through the vent 222 is allowed. However, the vent 222 is provided on a side of the push switch 1 far from the contact device (the movable contact part 42 and the first fixed contact part 611) in the left and right directions. Even when dust, grit, or the like intrudes into the recess 21 through the vent 222, such dust, grit, or the like may be suppressed from adhering to the contact device.

In more detail, the protection sheet 5 includes a joining part 51, a push part 52, and an intermediate part 53. The protection sheet 5 is joined to the surrounding wall 22 of the case 2 at the joining part 51 and covers the recess 21 by the push part 52 and the intermediate part 53.

The joining part 51 is joined to the upper surface of the surrounding wall 22. In this regard, the joining part 51 is provided to a flat part of the protection sheet 5 which has a rectangular frame shape serving as an outer peripheral part thereof and is parallel to the specific surface 211 of the base member 20. The joining part 51 is a linear area with a predetermined width which is located slightly inward from the outer periphery of the protection sheet 5 and is set along the outer periphery of the protection sheet 5. The joining part 51 is joined to the area surrounding the recess 21 of the case 2 by welding. Therefore, in contrast to the case where the joining part 51 is joined to the case 2 with adhesive, there is no adhesive on the lower surface of the protection sheet 5. In the present embodiment, the joining part 51 is joined to the area surrounding the recess 21 of the case 2 by laser welding. The joining part 51 is joined to the case 2 at almost all of the area surrounding the recess 21 except the groove 221.

The push part 52 faces the pressure reception member 31 of the movable member 3. In this regard, the push part 52 is constituted by circular part of the protection sheet 5 which forms center part thereof. The push part 52 is flat part parallel to the specific surface 211 of the base member 20.

The intermediate part 53 is present between the joining part 51 and the push part 52. In this regard, part of the protection sheet 5 other than the joining part 51 and the push part 52 constitutes the intermediate part 53. In summary, entire part of the protection sheet 5 surrounded by the joining part 51 but excluding the push part 52 constitutes the intermediate part 53. In the present embodiment, at least part of the intermediate part 53 is separate from the movable member 3. The intermediate part 53 is inclined relative to the specific surface 211 of the base member 20 so that part closer to the inner periphery (the push part 52) is more separate from the specific surface 211 of the base member 20.

The push member 7 is located between the push part 52 of the protection sheet 5 and the pressure reception member 31 of the movable member 3. The push member 7 is made of synthetic resin and has electrical insulating properties. The push member 7 has a disc shape flat in the upward and downward directions. The push member 7 is located over the movable member 3 with a lower surface of the push member 7 in contact with the upper surface of the pressure reception member 31. An upper surface of the push member 7 is joined to a lower surface of the push part 52 by laser welding, for example.

The push member 7 transfers the manual operation force acting on the push part 52 of the protection sheet 5 to the pressure reception member 31 of the movable member 3. Therefore, when the manual operation force acts on the push part 52 from the above, the manual operation force is transferred to the pressure reception member 31 by way of the push member 7 and accordingly acts on the pressure reception member 31 from the above. Hence, when the push part 52 is pushed, the pressure reception member 31 is operated indirectly through the push member 7.

(2.2) Operations

Hereinafter, operation of the push switch 1 with the aforementioned configuration is described referring to FIG. 6A to FIG. 7B. FIG. 6A to FIG. 7B show schematic views of section of the push switch 1 corresponding to FIG. 5. In this regard, concerning the movable member 3, the shape of the movable member 3 devoid of the through hole 32 is indicated by imaginary lines (dashed-two dotted lines) within the through hole 32.

Figure 6A:
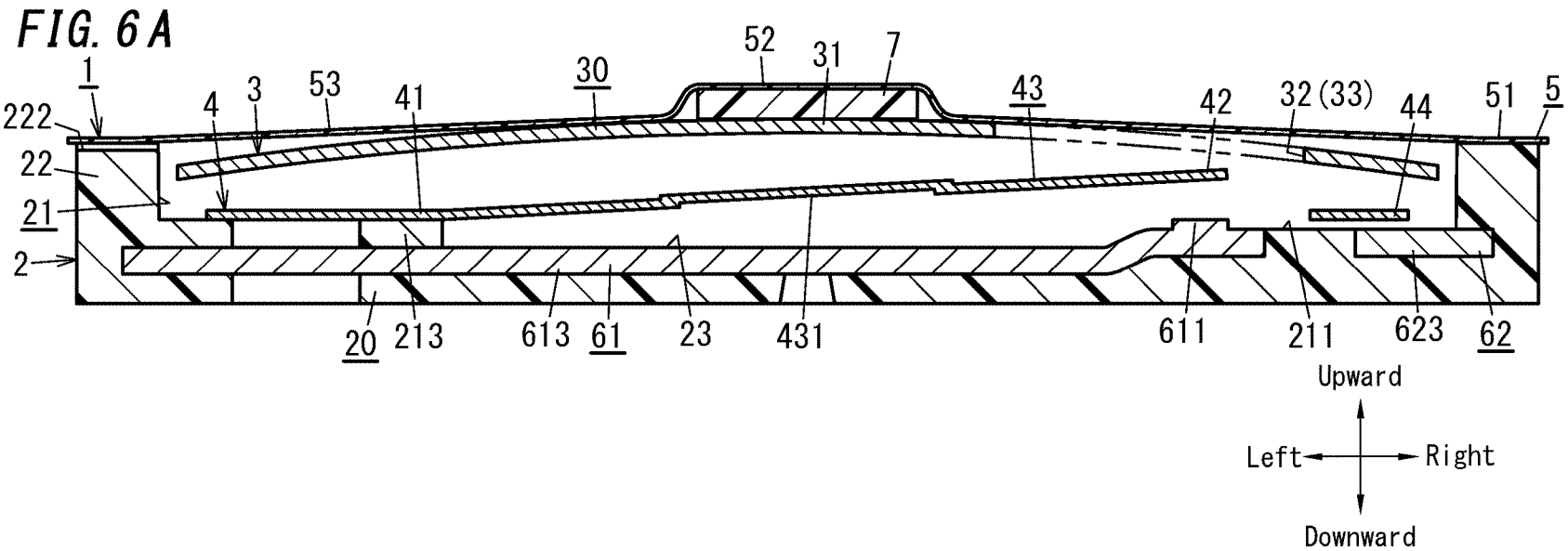
FIG. 6A is a sectional view of the push switch of the above, relating to a scene where manual operation has not been done.
Figure 6B:
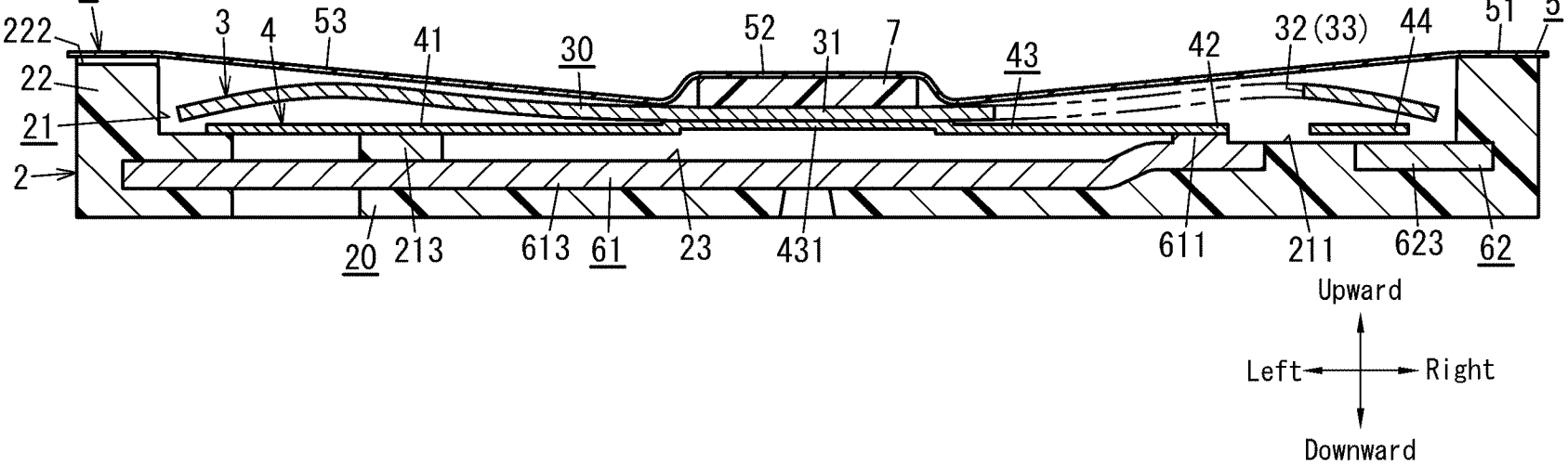
FIG. 6B is a sectional view of the push switch of the above, relating to a scene where manual operation has been done.
Figure 7A:
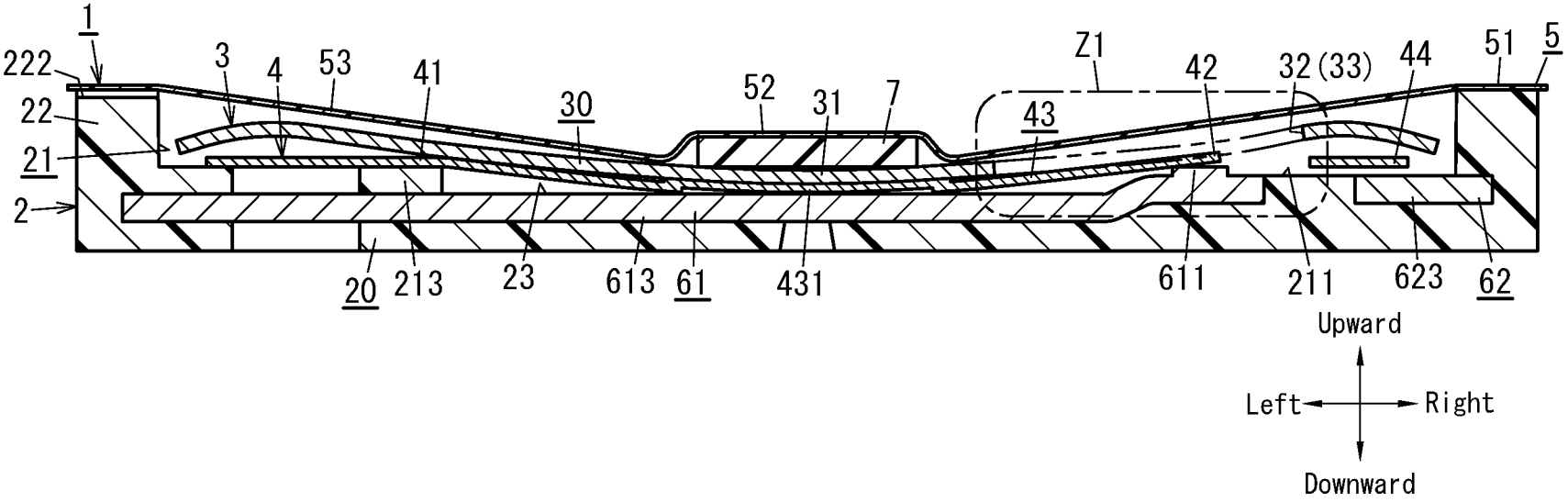
FIG. 7A is a schematic sectional view of the push switch of the above with overstroke.
Figure 7B:
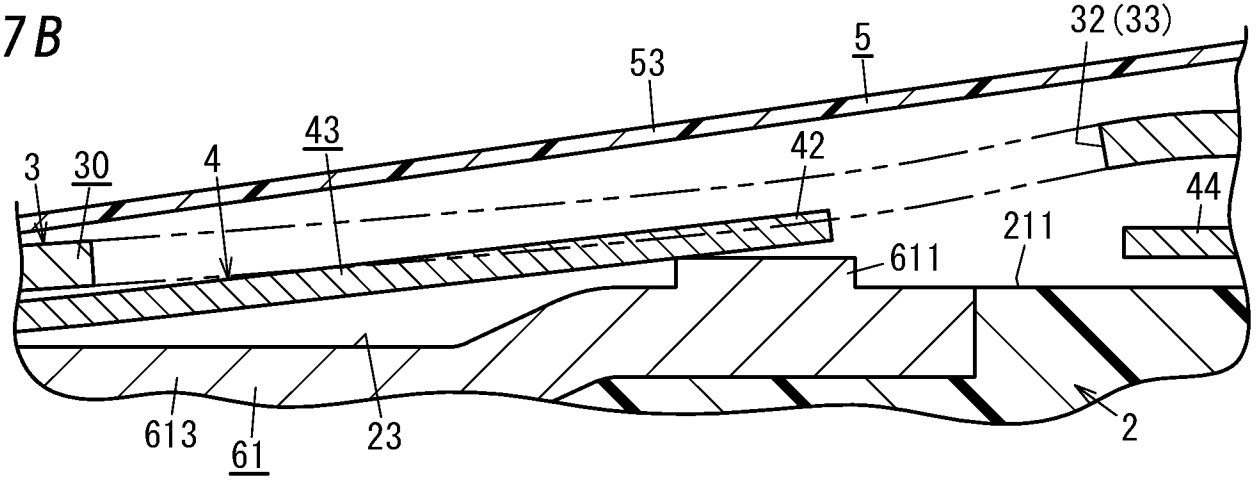
FIG. 7B is an enlarged view of region Z1 in FIG. 7A.

The push switch 1 is a normally-open switch. In manual operation, when push operation of the push part 52 of the protection sheet 5 is performed, the manual operation force directed downward acts on the push member 7 through the push part 52. FIG. 6A shows the push switch 1 not manually operated (in the state where the push operation is not performed). FIG. 6B relates to the manual operation of the push switch 1 and shows a scene where the push switch 1 is just turned on. FIG. 7A relates to the manual operation of the push switch 1 and shows a scene where overstroke occurs. FIG. 7B is an enlarged view of a region Z1 in FIG. 7A.

First, when the manual operation force acts on the pressure reception member 31 from the above through the push member 7, the pressure reception member 31 is pushed in a direction coming close to the bottom of the recess 21 (the specific surface 211) (the downward direction) as shown in FIG. 6A and FIG. 6B. Accordingly, the movable member 3 is changed in shape gradually. Thereafter, when magnitude of the manual operation force acting on the pressure reception member 31 exceeds a predetermined value, the movable member 3 buckles fast and furious and thus is changed in shape drastically. In this regard, elastic force of the body 30 acting on the pressure reception member 31 changes rapidly. In one example, so-called inversion of the movable member 3 as described above causes the body 30 to change into a shape such as a dome shape in which its center part (the pressure reception member 31) is curved to protrude downward. Accordingly, a user (operator) performing the push operation of the push switch 1 can be given tactile response (click feeling) by change in shape of the movable member 3.

Due to change in shape of the movable member 3, the lower surface of the pressure reception member 31 comes into contact with the protruded part 431 of the interconnection part 43 of the contact piece 40, and the interconnection part 43 is pushed by the movable member 3. Thus, the movable contact part 42 is moved downward with the interconnection part 43 bent. As shown in FIG. 6B, when the movable contact part 42 is moved to a position in contact with the first fixed contact part 611, the push switch 1 is turned on. In the state shown in FIG. 6B, the contact piece 40 is parallel to the specific surface 211 of the base member 20. In this state, electrical conduction is made between the first metal member 61 and the second metal member 62.

Further, when the push operation of the pressure reception member 31 is further performed in the state shown in FIG. 6B, the interconnection part 43 of the contact piece 40 is further bent downward as shown in FIG. 7A and additional movement of the pressure reception member 31 (i.e., overstroke) may occur. In this regard, the setback 23 serves as a space for back clearance which avoids interference with the contact piece 40. In other words, when the interconnection part 43 is further pushed by the movable member 3 in a state where the movable contact part 42 is in contact with the first fixed contact part 611 due to pushing of the movable member 3 by the interconnection part 43, the contact piece 40 is changed into a shape in which the interconnection part 43 enters the setback 23. In this push switch 1, the end of the movable range of the pressure reception member 31 is not a position where the push switch 1 is turned on but a position where the pressure reception member 31 is further pushed from the position the push switch 1 is turned on, as shown in FIG. 7A. According to the push switch 1, the timing at which the manual operation load increases drastically can be delayed by time corresponding to a distance by which the pressure reception member 31 moves from the position where the push switch 1 is turned on to the end of the movable range of the pressure reception member 31.

In the state where overstroke occurs, the contact piece 40 is warped in a direction where the top (right end of the movable contact part 42) is separate from the first fixed contact part 611, as shown in FIG. 7B. Therefore, the top (right end) and its vicinity of the contact piece 40 is inclined diagonally right up relative to the specific surface 211 of the base member 20. In this state, the movable contact part 42 provided to the top of the contact piece 40 is inserted into the through hole 32 formed in the movable member 3 and thereby interference between the movable contact part 42 and the movable member 3 can be avoided.

In contrast, when the manual operation force acting on the pressure reception member 31 is removed in the state where the body 30 is changed into, for example, a dome shape protruding downward, resilience of the movable member 3 allows the movable member 3 to recover to a dome shape in which its center part (the pressure reception member 31) is curved to protrude upward (change into its original shape) due to resilience of the movable member 3. In this regard, elastic force of the body 30 acting on the pressure reception member 31 changes rapidly, the body 30 recovers to (changes into) its original shape (the dome shape with its center part protruding upward) fast and furious. Accordingly, in response to end of the push operation, a user (operator) performing the push operation of the push switch 1 is given tactile response (click feeling) due to change in shape of the movable member 3. Thereafter, when the body 30 is changed into a dome shape protruding upward, the movable contact part 42 being the top of the contact piece 40 separates from the first fixed contact part 611 and the push switch 1 is turned off, as shown in FIG. 6A. In this state, no electrical conduction is made between the first metal member 61 and the second metal member 62.

(3) Variations

The following lists variations of the above embodiment.

In the above embodiment, the example where the base member 20 is part of the case 2 is described. The base member 20 may not be limited to part of the case 2 but may be part of a printed substrate (wiring board), for example. In such cases, the movable member 3 and the contact piece 40 may be located on or over the specific surface 211 of the printed substrate serving as the base member 20.

Figure 8:
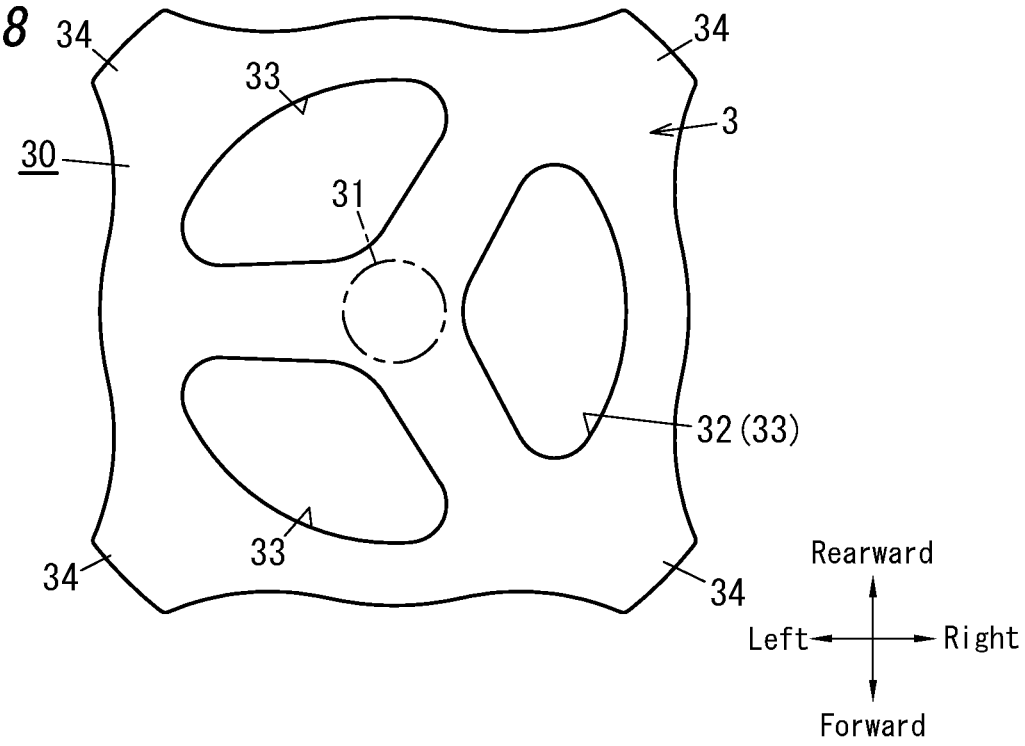
FIG. 8 is a plan view of a movable member of a push switch of one variation of one embodiment according to the present disclosure.

In the push switch 1, the opening shape of the recess 21 may not be limited to an almost rectangular shape but may be another shape such as a rectangular shape, a circular shape, or an oval shape. In this configuration, the shapes of the movable member 3, the contact member 4, and the protection sheet 5 may be decided in accordance with the opening shape of the recess 21. The shape of the holes 33 (the through hole 32) formed in the movable member 3 may not be limited to a leaf shape but may be another shape such as a triangle shape, a rectangular shape, or an oval shape. In one example, as shown in FIG. 8, the plurality of holes 33 (the through hole 32) each may be formed into a sector shape in a top view thereof. In this regard, the "sector shape" means a shape surrounded by two straight lines intersecting each other and an arc interconnecting opposite ends of these two straight lines from intersection point thereof. In the example shown in FIG. 8, a corner at the intersection point of the two straight lines and corners between the arc and the individual straight lines are each formed into a rounded shape (R shape) in a top view thereof. The number of holes 33 formed in the movable member 3 may not be limited to three but may be one. However, in consideration of the size or processing of the movable member 3, forming two to five holes 33 may be preferable.

The stroke length of the push switch 1 may be determined appropriately. For example, the push switch 1 may be any of a short stroke switch with relatively short stroke length, a long stroke switch with relatively long stroke length, and a meddle stroke switch intermediate between the short stroke switch and the long stroke switch. The push switch 1 may be a two-step operation switch including a first contact device and a second contact device. In the two-step operation push switch 1, the first contact device is turned on at first when the push part 52 is pushed. When the push part 52 is further pushed while the first contact device is on, the second contact device is turned on. In the two-step operation push switch 1, the movable member 3 may be constituted by a combination of two metal plates which buckle under mutually different manual operation forces, for example. The push switch 1 may not be limited to a normally-open switch but may be a normally-closed switch which is turned off only when operated.

The groove 221 formed in part of the area surrounding the recess 21 of the case 2 may be omitted. In this case, the protection sheet 5 can cover the open surface of the recess 21 to keep the recess 21 airtight. Therefore, the protection sheet 5 can prevent intrusion of water, flux, and the like into the recess 21 and therefore can protect the contact device and the like accommodated in the recess 21 from water, flux, and the like.

The first fixed contact part 611 may be flush with the specific surface 211 of the base member 20. However, as in the above embodiment, the configuration where the first fixed contact part 611 protrudes from the specific surface 211 of the base member 20 can ensure larger overstroke than the configuration where the first fixed contact part 611 is flush with the specific surface 211 of the base member 20. The movable contact part 42 facing the first fixed contact part 611 may be formed to protrude toward the first fixed contact part 611.

The upper surface of the pedestal 213, the upper surface of the first fixed contact part 611, and the upper surfaces of the pair of second fixed contact parts 621 may not be flush with each other. In other words, for example, the pedestal 213 and the pair of second fixed contact parts 621 may have the same protrusion amount from the specific surface 211 of the base member 20 but only the first fixed contact part 611 may have the different protrusion amount from them. Or, the pedestal 213 and the pair of second fixed contact parts 621 may have different protrusion amounts from the specific surface 211 of the base member 20. Even when the upper surface of the pedestal 213 is not flush with the upper surfaces of the pair of second fixed contact parts 621, the support frame 44 can be supported or borne on the specific surface 211 of the base member 20 with the pedestal 213 and the pair of second fixed contact parts 621. For example, when the pedestal 213 has the protrusion amount from the specific surface 211 of the base member 20 larger than the protrusion amounts of the pair of second fixed contact parts 621, the support frame 44 can be supported or borne on the specific surface 211 of the base member 20 in a diagonally right down posture. Or, when the pedestal 213 has the protrusion amount from the specific surface 211 of the base member 20 smaller than the protrusion amounts of the pair of second fixed contact parts 621, the support frame 44 can be supported or borne on the specific surface 211 of the base member 20 in a diagonally right up posture. The support frame 44 may be supported or borne to be inclined relative to the specific surface 211 of the base member 20 as described above, as long as the support frame 44 is in stable contact with the pair of second fixed contact parts 621 in every scene including the push operation of the push switch 1.

The conductive layer on the lower surface of the contact member 4 may not be limited to being formed on the entire lower surface of the contact member 4. For example, conductive layers may be formed on parts contact with the pair of second fixed contact parts 621 and the movable contact part 42. Alternatively, the conductive layer on the lower surface of the contact member 4 may be omitted appropriately. In this case, it may be preferable to ensure the electric conductivity of the contact member 4 by forming part of a whole of the contact member 4 of electrically conductive material.

The push switch 1 may not be limited to configuration which is used in a manual operation unit of a device and is to be operated by a person, but may be used in a detection unit of a device, for example. In the case where the push switch 1 is used in the detection unit of the device, the push switch 1 may be used as a limit switch for position detection of a mechanical pat such as an actuator or the like, for example.

The movable member 3 may not be made of a single plate but may be made of a stack of metal plates. In this case, magnitude of the manual operation force necessary for the movable member 3 to buckle changes depending on the number of stack of metal plates, thereby the tactile feeling during manual operation of the push switch 1 changed.

The push member 7 may not be located between the push part 52 and the pressure reception member 31 but may be located over the push part 52, for example. In this case, the lower surface of the push member 7 may be joined to the upper surface of the protection sheet 5. In this configuration, the manual operation force acting on the push member 7 may be transferred to the pressure reception member 31 through the push part 52.

It may be sufficient that the protection sheet 5 covers the recess 21 with the push part 52 and the intermediate part 53. Covering the recess 21 entirely with the protection sheet 5 is not always necessary for the push switch 1. For example, there may be at least one hole formed in part of the protection sheet 5. The intermediate part 53 may not be separate from the movable member 3. For example, part of the intermediate part 53 may be in contact with the movable member 3.

(4) Conclusion

As described above, the push switch 1 according to a first aspect includes a (first) fixed contact part 611, a base member 20, a contact piece 40, and a movable member 3. The base member 20 supports the fixed contact part 611. The contact piece 40 is located at a position facing a specific surface 211 of the base member 20 in operation directions (upward and downward directions). The movable member 3 includes a pressure reception member 31 and is located at a position on an opposite side of the contact piece 40 from the specific surface 211 of the base member 20 in the operation directions. The movable member 3 includes a through hole 32 which is located in an area surrounding the pressure reception member 31 and penetrates the movable member 3 in the operation directions. The contact piece 40 includes a support part 41 supported on the base member 20, a movable contact part 42 movable between a position in contact with the fixed contact part 611 and a position separate from the fixed contact part 611, and an interconnection part 43 interconnecting the support part 41 and the movable contact part 42. The contact piece 40 is configured so that, when the pressure reception member 31 is pushed to be moved closer to the specific surface 211 of the base member 20 to cause change in shape of the movable member 3, the interconnection part 43 is pushed by the movable member 3 and the movable contact part 42 is moved along the operation directions. The movable contact part 42 is located at a position facing the through hole 32 in the operation directions and has a size and shape to be allowed to pass through the through hole 32 in the operation directions.

According to this configuration, (tactile) feeling during manual operation of the push switch 1 is ensured by the movable member 3 and the electrical connection is realized by the contact piece 40. In other words, in the push switch 1, the movable member 3 and the contact piece 40 are independently in charge of ensuring the feeling during manual operation and the electric connection. The feeling during manual operation and the electrical connection can be designed separately. Therefore, the push switch 1 can realize various feeling during manual operation without limitation by electrical connection conditions. Additionally, interference between the movable contact part 42 and the movable member 3 can be avoided by the through hole 32 even when the movable contact part 42 moves in the operation directions. Hence, a distance between the movable member 3 and the contact piece 40 in the operation directions can be shortened. Consequently, in contrast to configuration where only the movable member 3 is in charge of ensuring the feeling during manual operation and electric connection both, increase in a dimension of the push switch 1 in the operation directions can be reduced notwithstanding the contact piece 40 being added between the movable member 3 and the specific surface 211 of the base member 20. As a result, the push switch 1 can offer advantageous effects of being lowered in height and of providing various feeling during manual operation.

In the push switch 1 according to a second aspect which would be realized in combination with the first aspect, the contact piece 40 may preferably be a cantilever with the support part 41 serving as a fixed end and the movable contact part 42 serving as a free end. According to this configuration, the sufficient stroke of the movable contact part 42 can be ensured by relatively simple configuration. However, the contact piece 40 formed as a cantilever may be optional for the push switch 1. For example, the contact piece 40 may be formed into a double fixed beam shape. In this case, the movable contact part 42 may be provided at center part in a length direction of the contact piece 40 or may be provided to each of opposite ends in the length direction.

In the push switch 1 according to a third aspect which would be realized in combination with the first or second aspect, the base member 20 may preferably include a setback 23 which is located at a position in the specific surface 211 facing the interconnection part 43 in the operation directions and is recessed in a direction apart from the interconnection part 43. According to this configuration, the movable range of the interconnection part 43 can be expanded by the setback 23 and the stroke length of the push switch 1 therefore can be increased. However, the setback 23 is optional for the push switch 1 and the setback 23 can be omitted appropriately.

In the push switch 1 according to a fourth aspect which would be realized in combination with the third aspect, the contact piece 40 may preferably be configured to change in shape allowing the interconnection part 43 to enter the setback 23 when the interconnection part 43 is further pushed by the movable member 3 in a state where the interconnection part 43 is pushed by the movable member 3 to allow the movable contact part 42 to be in contact with the fixed contact part 611. According to this configuration, the space serving as back clearance for the interconnection part 43 is formed by the setback 23, and it is possible to allow further movement (overstroke) of the pressure reception member 31 caused by the push operation of the pressure reception member 31 after the movable contact part 42 comes into contact with the fixed contact part 611. According to the overstroke push switch 1, the timing at which the manual operation load increases drastically can be delayed by time corresponding to a distance by which the pressure reception member 31 moves from the position where the push switch 1 is turned on to the end of the movable range of the pressure reception member 31. Therefore it is possible to reduce tiredness of a user (operator) who perform operation (the push operation) of the push switch 1 actually. However, allowing the overstroke may be optional for the push switch 1 and the push switch 1 may not be an overstroke switch.

In the push switch 1 according to a fifth aspect which would be realized in combination with any one of the first to fourth aspects, the interconnection part 43 may preferably include a protruded part 431 protrude in the operation directions but away from the specific surface 211 of the base member 20. In this case, the contact piece 40 may preferably be configured to come into contact with the movable member 3 at the protruded part 431 when the pressure reception member 31 is pushed. According to this configuration, the contact piece 40 can stably receive push force from the pressure reception member 31 by the protruded part 431. In other words, the contact piece 40 is in contact with the movable member 3 at the protruded part 431 and therefore it is possible to reduce deviation of contact position between the contact piece 40 and the movable member 3 which would otherwise be caused by twist occurring in manufacture of the contact piece 40. However, the protruded part 431 may be optional for the push switch 1 and the protruded part 431 can be omitted appropriately.

In the push switch 1 according to a sixth aspect which would be realized in combination with any one of the first to fifth aspects, the base member 20 may preferably be at least part of a case 2 including a recess 21 and the contact piece 40 may preferably be at least part of a contact member 4 which is electrically conductive. In this case, the specific surface 211 of the base member 20 may preferably be a bottom surface of the recess 21 and the movable member 3 and the contact member 4 may preferably be located inside the recess 21. According to this configuration, by accommodating the movable member 3 and the contact member 4 in the recess 21 of the case 2, the push switch 1 can be treated as a single independent device. However, the base member 20 being at least part of the case 2 including the recess 21 may be optional for the push switch 1 and the base member 20 may be part of a printed substrate, for example.

In the push switch 1 according to a seventh aspect which would be realized in combination with the sixth aspect, the base member 20 may preferably further include a second fixed contact part 621 which is electrically insulated from the fixed contact part serving as a first fixed contact part 611. In this case, the first fixed contact part 611 and the second fixed contact part 621 may preferably be located on the specific surface 211 of the base member 20 and separate from each other. In this case, the contact member 4 may preferably include the contact piece 40 and a support frame 44 in permanent contact with the second fixed contact part 621. In this case, the contact piece 40 may preferably protrude along the specific surface 211 of the base member 20 from part of the support frame 44 so that the movable contact part 42 is located at a position facing the first fixed contact part 611 in the operation directions. According to this configuration, a mechanism for making and breaking electric conduction between the first fixed contact part 611 and the second fixed contact part 621 can be realized by use of the contact member 4 in a simplified shape such as an almost flat plate shape. Therefore, it is possible to increase the degree of freedom of arrangement of the first fixed contact part 611, the second fixed contact part 621, and the like inside the recess 21. However, the second fixed contact part 621 may be optional for the push switch 1 and for example a mechanism for making and breaking electric conduction between the contact piece 40 and the first fixed contact part 611 can be adopted.

In the push switch 1 according to an eighth aspect which would be realized in combination with the sixth or seventh aspect, the case 2 may preferably include at least part of an internal side surface 212 of the recess 21 a movement limitation part 214. The movement limitation part 214 may preferably limit movement of the contact member 4 and the movable member 3 in an imaginary plane parallel to the specific surface 211 of the base member 20 by coming into contact with the contact member 4 and the movable member 3. According to this configuration, within an imaginary plane parallel to the specific surface 211 of the base member 20, the contact member 4 and the movable member 3 can be positioned in predetermined locations. Further, the positioning can be realized by at least part of the internal side surface 212 of the recess 21 and therefore attaching the contact member 4 and the movable member 3 to the case 2 can be facilitated. However, the movement limitation part 214 may be optional for the push switch 1 and the movement limitation part 214 may be omitted appropriately.

In the push switch 1 according to a ninth aspect which would be realized in combination with any one of the sixth to eighth aspects, the movable member 3 may preferably include a body 30 including the pressure reception member 31 and the through hole 32, and four legs 34 individually protruding in four directions from an outer periphery of the body 30 when viewed in one of the operation directions. According to this configuration, the movable direction of the pressure reception member 31 can be extended by the four legs 34 and the stroke length of the push switch 1 therefore can be increased. However, the movable member 3 including the four legs 34 may be optional for the push switch 1. The movable member 3 may not include any leg 34 or may include one to three or five or more legs.

In the push switch 1 according to a tenth aspect which would be realized in combination with any one of the sixth to ninth aspects, the movable member 3 may preferably include in an area surrounding the pressure reception member 31 a plurality of holes 33 which have a same shape and are arranged in a circumferential directions of the pressure reception member 31 at regular intervals. In this case, the through hole 32 may preferably be one of the plurality of holes 33. According to this configuration, the rigidity of the movable member 3, that is, the manual operation load of the push switch 1 can be adjusted by the shape and number of plurality of holes 33 formed in the movable member 3. Additionally, the plurality of holes 33 are arranged in the circumferential direction of the pressure reception member 31 at regular intervals, and therefore the movable member 3 can be changed in shape uniformly in the circumferential direction of the pressure reception member 31. In consideration of avoidance of interference with the movable contact part 42 by the through hole 32 and appropriate manual operation load, the number of holes 33 formed in the movable member 3 may preferably be three. However, the movable member 3 including the plurality of holes 33 which have the same shape and are arranged in the circumferential directions of the pressure reception member 31 at regular intervals may be optional for the push switch 1. For example, only one hole 33 (the through hole 32) may be included, and the plurality of holes 33 may not always have the same shape and be arranged at regular intervals.

The push switch according to an eleventh aspect which would be realized in combination with any one of the sixth to tenth aspects, may preferably further include a protection sheet 5 which is joined to an area surrounding the recess 21, of the case 2 and covers the recess 21. In this case, the case 2 may preferably include a groove 221 for forming a gap between at least part of the area surrounding the recess 21 and the protection sheet 5. The groove 221 may preferably serve as a vent 222 which is between the case 2 and the protection sheet 5 and interconnects an inside of the recess 21 and an outside of the recess 21. According to this configuration, in the push operation of the push switch 1, air flow between the inside of the recess 21 and the outside of the recess 21 through the vent 222 is allowed. Therefore, it is possible to reduce degradation of the feeling during manual operation which would otherwise be caused by compression of air inside the recess 21 by the push operation of the push switch 1 and also it is possible to realize relatively small manual operation load. Further, in the recovery after the manual operation (recovering of the movable member 3), air can flow into the recess 21 through the vent 222. Therefore, the recovery can become fine. However, the groove 221 may be optional for the push switch 1 and therefore the groove 221 can be omitted appropriately.

REFERENCE SIGNS LIST

1 Push Switch
2 Case
3 Movable Member
4 Contact Member
5 Protection Sheet
20 Base Member

21 Recess
23 Setback
30 Body
31 Pressure Reception Member
32 Through Hole
33 Hole
34 Leg
40 Contact Piece
41 Support Part
42 Movable Contact Part
43 Interconnection Part
44 Support Frame
211 Specific Surface (Bottom Surface of Recessed Part)
212 Internal Side Surface
214 Movement Limitation Part
221 Groove
222 Vent
431 Protruded Part
611 (First) Fixed Contact Part
621 Second Fixed Contact Part

The invention claimed is:

1. A push switch comprising:
a fixed contact part;
a base member supporting the fixed contact part;
a contact piece located at a position facing a specific surface of the base member in operation directions; and
a movable member including a pressure reception member and located at a position on an opposite side of the contact piece from the specific surface of the base member in the operation directions,
the movable member including a through hole which is located in an area surrounding the pressure reception member and penetrates the movable member in the operation directions,
the contact piece including a support part supported on the base member, a movable contact part movable between a position in contact with the fixed contact part and a position separate from the fixed contact part, and an interconnection part interconnecting the support part and the movable contact part,
the contact piece being configured so that, when the pressure reception member is pushed to be moved closer to the specific surface of the base member to cause change in shape of the movable member, the interconnection part is pushed by the movable member and the movable contact part is moved along the operation directions, and
the movable contact part being located at a position facing the through hole in the operation directions and having a size and shape to be allowed to pass through the through hole in the operation directions.

2. The push switch according to claim 1, wherein
the contact piece is a cantilever with the support part serving as a fixed end and the movable contact part serving as a free end.

3. The push switch according to claim 1, wherein
the base member includes a setback which is located at a position in the specific surface facing the interconnection part in the operation directions and is recessed in a direction apart from the interconnection part.

4. The push switch according to claim 3, wherein
the contact piece is configured to change in shape allowing the interconnection part to enter the setback when the interconnection part is further pushed by the movable member in a state where the interconnection part is pushed by the movable member to allow the movable contact part to be in contact with the fixed contact part.

5. The push switch according to claim 1, wherein:
the interconnection part includes a protruded part protrude in the operation directions but away from the specific surface of the base member; and
the contact piece is configured to come into contact with the movable member at the protruded part when the pressure reception member is pushed.

6. The push switch according to claim 1, wherein:
the base member is at least part of a case including a recess;
the contact piece is at least part of a contact member which is electrically conductive;
the specific surface of the base member is a bottom surface of the recess; and
the movable member and the contact member are located inside the recess.

7. The push switch according to claim 6, wherein:
the base member further includes a second fixed contact part which is electrically insulated from the fixed contact part serving as a first fixed contact part;
the first fixed contact part and the second fixed contact part are located on the specific surface of the base member and separate from each other;
the contact member includes the contact piece and a support frame in permanent contact with the second fixed contact part; and
the contact piece protrudes along the specific surface of the base member from part of the support frame so that the movable contact part is located at a position facing the first fixed contact part in the operation directions.

8. The push switch according to claim 6, wherein
the case includes at least part of an internal side surface of the recess a movement limitation part for limiting movement of the contact member and the movable member in an imaginary plane parallel to the specific surface of the base member by coming into contact with the contact member and the movable member.

9. The push switch according to claim 6, wherein
the movable member includes a body including the pressure reception member and the through hole, and four legs individually protruding in four directions from an outer periphery of the body when viewed in one of the operation directions.

10. The push switch according to claim 6, wherein:
the movable member includes in an area surrounding the pressure reception member a plurality of holes which have a same shape and are arranged in a circumferential directions of the pressure reception member at regular intervals; and
the through hole is one of the plurality of holes.

11. The push switch according to claim 6, further comprises a protection sheet which is joined to an area surrounding the recess of the case and covers the recess,
wherein:
the case includes a groove for forming a gap between at least part of the area surrounding the recess and the protection sheet; and
the groove serves as a vent which is between the case and the protection sheet and interconnects an inside of the recess and an outside of the recess.

* * * * *